US005260983A

United States Patent [19]

Ono et al.

[11] Patent Number: 5,260,983

[45] Date of Patent: Nov. 9, 1993

[54] X-RAY TUBE APPARATUS

[75] Inventors: Katsuhiro Ono, Utsunomiya; Hiroyuki Sugiura, Tochigi; Makoto Tanaka, Ootawara, all of Japan

[73] Assignee: Kabushiki Kaisha Toshiba, Kawasaki, Japan

[21] Appl. No.: 988,874

[22] Filed: Dec. 10, 1992

[30] Foreign Application Priority Data

Dec. 10, 1991 [JP] Japan ..... 3-325449

[51] Int. Cl.[5] ..... H01J 35/10

[52] U.S. Cl. ..... 378/133; 378/93

[58] Field of Search ..... 378/132, 133, 93, 94

[56] References Cited

U.S. PATENT DOCUMENTS 4,210,371 7/1980 Gerkema et al. .
4,305,631 12/1991 Iversen .
4,644,577 2/1987 Gerkema et al. .
4,914,684 4/1990 Upadhya .
5,189,688 2/1993 Ono et al. ..... 378/133

FOREIGN PATENT DOCUMENTS 0149869 7/1985 European Pat. Off. .
0488311 6/1992 European Pat. Off. .
2010985 7/1979 United Kingdom .

*Primary Examiner*—Craig E. Church
*Attorney, Agent, or Firm*—Cushman, Darby & Cushman

[57] ABSTRACT

An X-ray apparatus is provided with an operation process in which an AC voltage is applied from a power source to a magnetic stator coil so that the components of bearings are heated by magnetic induction to melt a metal lubricant in the bearings. Thus, the lubricant can be efficiently melted before starting rotation without additionally using extra components in an X-ray tube, so that the apparatus can enjoy stable operation.

14 Claims, 3 Drawing Sheets

X-RAY TUBE APPARATUS

BACKGROUND OF THE INVENTION

1. Field of the Invention

The present invention relates to an X-ray apparatus, and more particularly, to an X-ray apparatus provided with an X-ray tube having slide bearings therein and using a liquid metal as a lubricant.

2. Description of the Related Art

Many of X ray apparatuses, such as X-ray photographing apparatuses, X-ray exposure apparatuses, CT scanners, etc. incorporate a rotating-anode X-ray tube for use as an X-ray radiation source. In the X-ray tube of this type, as is generally known, a disk-shaped anode target is fixed to a rotating structure, which is rotatably supported on a stationary structure by a bearing section formed therebetween. A magnetic stator coil is arranged outside a vacuum envelope, and the rotating structure is rotated at high speed when the stator coil is energized. While the rotating structure is rotating at high speed, an electron beam emitted from a cathode is applied to the anode target, whereby X-rays are irradiated. The bearing section is composed of bearings, such as ball bearings, or dynamic-pressure slide bearings which have spiral grooves on their bearing surfaces. The slide bearings use a liquid metal lubricant which, formed of gallium or a gallium-indium-tin (Ga-In-Sn) alloy, becomes liquid during operation. X-ray tubes which use the slide bearings are disclosed in, for example, Published Japanese Patent Application No. 60-21463 and Published Unexamined Japanese Patent Applications Nos. 60-97536, 60-117531, 60-160552, 62-287555, 2-227947, and 2-227948.

The liquid metal lubricant applied in the slide bearings of these rotating-anode X-ray tubes has a practical melting point of about 10° C. at the lowest. More specifically, the melting point of a low-melting Ga-In-Sn alloy is 10.7° C., and that of a low-melting Bi-In-Pb-Sn alloy, whose bismuth (Bi) content is relatively high, is 57° C. In some cases, the X-ray tube apparatuses are used at a temperature lower than the melting point of the metal lubricant, so that the lubricant in the bearing section of the X-ray tube is frozen or solidified before the operation of the apparatus is started. In this state, the anode target cannot rotate so that the anode target surface is damaged by an excessive temperature rise due to the electron bombardment. It is necessary, therefore, to melt and liquidify the lubricant by heating the bearing section to a temperature higher than the melting point of the lubricant before starting the rotation of the anode target of the X-ray tube. To attain this, the X-ray tube disclosed in Published Unexamined Japanese Patent Application No. 60-160552 is arranged so that a heat source, such as a heating coil, heat radiator, or high-frequency radiator, is provided in- or outside the X-ray tube, and that heat radiation of a cathode filament is utilized.

Inevitably, however, this arrangement requires the additional use of an extra heat source. Further, it takes a lot of time to increase the temperature of the bearing section by utilizing the heat radiation of the cathode filament.

SUMMARY OF THE INVENTION

The object of the present invention is to provide an X-ray apparatus in which a metal lubricant in a bearing section can be efficiently melted, thereby ensuring reliable starting of rotation, without the additional use of any extra components.

According to the one aspect of the invention, there is provided an X-ray apparatus comprising:

anode target;

a rotating structure fixedly fitted with the anode target;

a stationary structure for rotatably supporting the rotating structure;

a slide bearing section formed between the rotating structure and the stationary structure and including a bearing gap between the stationary structure and the rotating structure and spiral grooves formed on at least one of the rotating and stationary structures;

a metal lubricant having a melting point and applied in the spiral bearing section, the metal lubricant being in a liquid state at a temperature higher than the melting point and the metal lubricant being in a solid state at a temperature lower than the melting point;

an envelope for receiving the anode target and the stationary and rotating structures;

a magnetic stator coil, arranged outside of the envelope, for generating a magnetic field to rotate the rotating structure;

a power source for selectively applying preheating and rotation electric powers to the magnetic stator coil, thereby energizing the coil; and means for setting the power source in a preheating stage when the metal lubricant is in the solid state and in a rotation state when the metal lubricant is in the liquid stage, wherein the setting means causes the power source to apply the preheating electric power to the stator coil in the preheating stage so that the bearing section is heated by magnetic induction caused by the magnetic field, whereby the lubricant in the bearing section is melted, and the setting means causes the power source to apply the rotation electric power to the stator coil in the rotation stage so that the rotating structure is rotated by the magnetic field.

According to the another aspect of the invention, there is provided an X ray apparatus comprising:

an X-ray tube including:

an anode target;

a rotating structure fixedly fitted with an anode target;

a stationary structure for rotatably supporting the rotating structure;

a slide bearing section formed between the rotating structure and the stationary structure and including a bearing gap between the stationary structure and the rotating structure and spiral grooves formed on one of the rotating structure and the stationary structure;

a metal lubricant having a melting point and applied in the bearing section; and an envelope for receiving the anode target and the stationary and rotating structures;

a magnetic stator coil surrounding the rotating structure, for generating a magnetic field for rotating the rotator;

a power source for selectively applying preheating and rotation voltages to the magnetic stator coil, thereby energizing the stator coil; and means for setting the power source in one of preheating and rotation stages, wherein the setting means causes the power source, in the preheating stage, to generate the preheating voltage having a level enough not to rotate the rotating structure and sufficient for generating a magnetic field to induce a heat applied to the bearing section and melt the metal lubricant for a predetermined period and the setting means causes the power source to generate the rotation voltage having a level enough to rotate the rotating structure in the rotation stage.

According to the yet another aspect of the invention, there is provided an X-ray apparatus comprising:

an anode target;

a rotating structure fixedly fitted with the anode target;

a stationary structure for rotatably supporting the rotating structure;

a slide bearing section formed between the rotating structure and the stationary structure and including a bearing gap between the stationary structure and the rotating structure and spiral grooves formed on one of the rotating and stationary structures;

a metal lubricant having a meting point and applied in the spiral bearing section the metal lubricant being in a liquid state at a temperature higher than the melting point and the metal lubricant being in a solid state at a temperature lower than the melting point;

an envelope for receiving the anode target and the stationary and rotating structures;

a magnetic stator coil, arranged outside of the envelope, for generating a magnetic field to rotate the rotating structure;

a power source for selectively applying first and second voltages to the magnetic stator coil, thereby energizing the coil; and means for controlling the power source to generate the first voltage having a first level when the metal lubricant is in the solid state and to generate the second voltage having a second level when the metal lubricant is in the liquid stage, wherein the stator coil applied with the first voltage generates the magnetic field inducing a heat which is sufficient to melt the metal lubricant and the stator coil applied with the second voltage generates the magnetic field for rotating the rotating structure.

According to the yet further aspect of the invention, there is provided an X-ray apparatus comprising:

an anode target;

a rotating structure fixedly fitted with the anode target;

a stationary structure for supporting the rotating structure;

a slide bearing section formed between the rotating structure and the stationary structure and including a bearing gap between the stationary structure and the rotating structure and spiral grooves formed on one of the rotating and stationary structures;

a metal lubricant and applied in the spiral bearing section;

an envelope for receiving the anode target and the stationary and rotating structures;

a magnetic stator coil, arranged outside of the envelope, for generating a magnetic field to rotate the rotating structure;

a power source for selectively applying first and second electric powers to the magnetic stator coil, thereby energizing the coil; and means for setting the power source to generate the first electric power for a predetermined heating period and to generate the second electric power after the heating period, wherein the stator coil applied with the first electric power generates the magnetic field inducing a heat which is applied to the bearing section and the stator coil applied with the second electric power generates the magnetic field for rotating the rotating structure.

According to the X-ray apparatus of the invention, heat attributable to an induced current loss is produced in a rotator or stationary column, which has a spiral-groove bearing section, by means of the AC electric power applied to the magnetic stator coil even when the lubricant is frozen, so that the temperature of the lubricant in the bearing section can efficiently increase. Accordingly, the rotation of the rotator can be started when the lubricant is securely heated to a temperature higher than its melting point to become liquid. Thus, the X-ray tube apparatus can enjoy safe and stable operation even at a temperature lower than the melting point of the metal lubricant.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
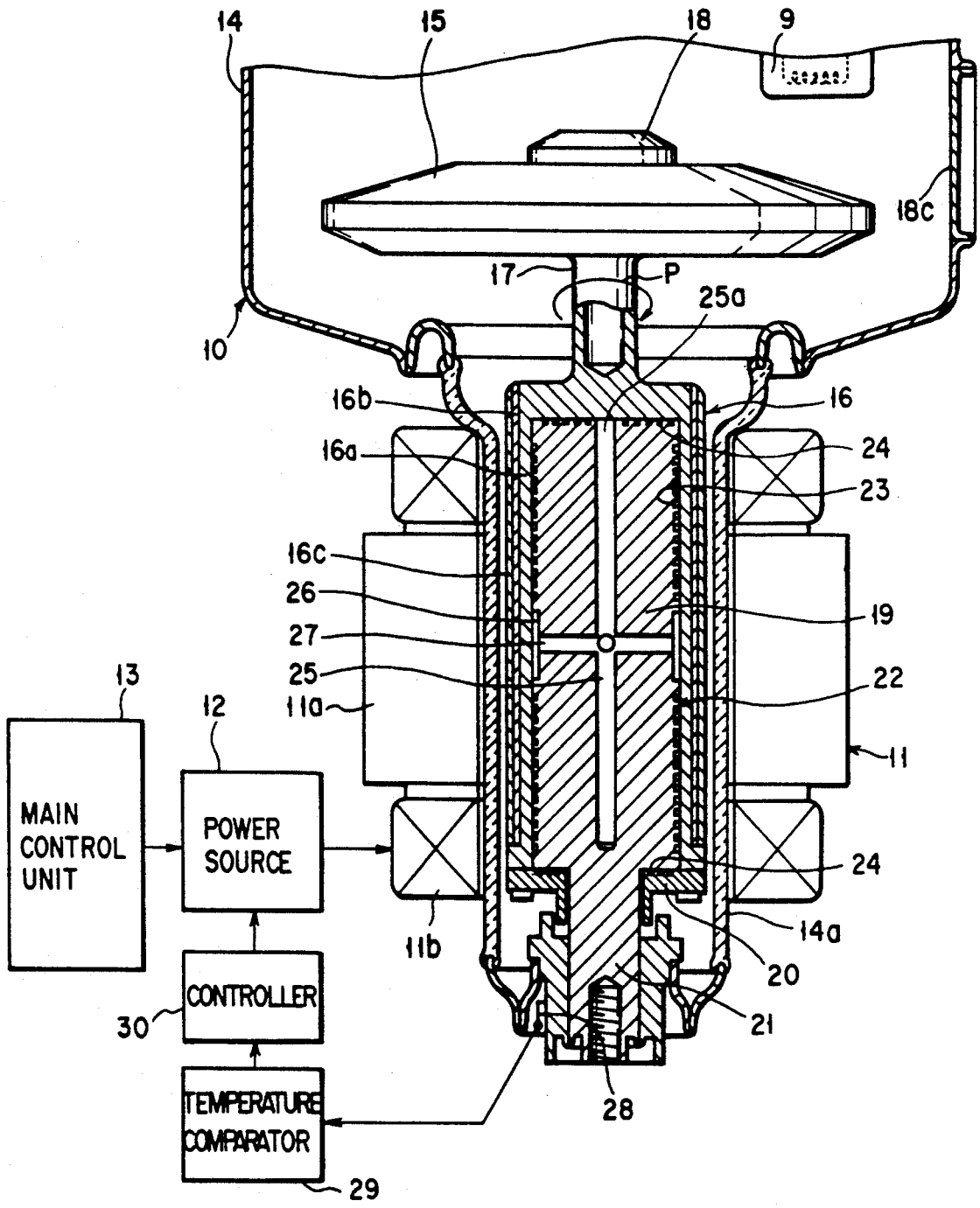
FIG. 1 is a longitudinal sectional view schematically showing an X-ray apparatus according to an embodiment of the present invention.

X-ray tube apparatuses according to preferred embodiments of the present invention will now be described in detail with reference to the accompanying drawings, in which like reference numerals refer to the same parts throughout the several views.

An X-ray apparatus according to an embodiment shown in FIG. 1 comprises a X-ray tube 10 of a rotating anode type, a high voltage power source (not shown) for energizing a cathode 9 and a anode 15, a stator unit 11, a power source 12 for driving the stator unit 11, and a main control unit 13 for controlling the X-ray apparatus.

In the X-ray tube 10 of the rotating anode type, a rotating shaft 17 protrudes from one end of a cylindrical rotating structure 16 and a disk-shaped rotating anode target 15 of heavy metal is fixed to the rotating shaft 17 by a fixing nut 18 in a vacuum envelope 14. A stationary structure or column 19 is fitted coaxially in the rotating structure 16 and a ring-shaped closing member 20 is fixed to a lower-end opening of the rotating structure 16. The lower end portion of the stationary column 19 has an anode supporting portion 21 which is airtightly bonded to a cylindrical glass sealing portion 14*a* of the vacuum envelope 14.

A spiral-groove bearing section 22 of a dynamic-pressure type is formed between the rotating structure 16 and the stationary structure 19. The spiral-groove bearing section 22 of a dynamic-pressure type is disclosed in the aforementioned Japanese patent applications. In the bearing section, spiral grooves 23 and 24, formed of herringbone patterns such as the ones described in the aforementioned patent applications, are formed on the outer peripheral surface of the stationary column 19 to constitute a radial bearing and, end faces of the stationary column 19 and the closing member 20 to constitute a thrust bearing. The slide bearing surfaces of the rotating structures, which face the bearing surfaces of the stationary structure with a bearing gap, may be simple smooth surfaces, or may be formed of spiral grooves, if necessary. The respective bearing surfaces of the rotating structure and the stationary column are situated close to one another with the bearing gap of about 20 micrometers between them. The stationary column 19, which is located on the axis of rotation, has a lubricant chamber 25 formed by axially boring the central portion of the column 19. An intermediate portion of the stationary column 19 is slightly shaved to form a small-diameter portion 26. Four radial lubricant passages 27 are symmetrically arranged at regular angular intervals, connecting the chamber 25 and a recess space between the portion 26 and the inner surface of the rotating structure 16. The lubricant chamber 25 is opened at the center region of the end face of the stationary column 19 to form an upper-end opening 25*a*. Thus, the opening 25*a* is communicated with the bearing gap of a thrust bearing between the end face of the stationary column 19 and the rotating structure 16. In the thrust bearing, no groove is formed in the center region of the end face of the column 19 but spiral grooves 24 are formed as a herringbone pattern in the peripheral region around the central region of the end face of the column.

In a rotating structure 16, a rotating cylinder 16*b*, formed of iron or other ferromagnetic material, and a copper cylinder 16*c* are fitted and fixed integrally on a bottomed cylinder 16*a*. These cylinders operate as rotor means of a magnetic induction motor, in conjunction with the stator 11 outside the cylindrical glass portion 14*a*, which surrounds the rotating structure 16. The stator 11 includes a cylindrical core 11*a* and a magnetic coil 11*b* wound thereon. The magnetic stator coil 11*b*, which is connected to a circuit such that it is supplied with a driving voltage from the power source, generates a rotating magnetic field which is applied to the inside of the rotating structure 16.

A temperature sensor 28 is attached to the outer surface of the anode supporting portion 21 at the outside of the tube. In consideration of the coefficient of heat transfer from the bearing section 22 to the temperature sensor 28 on the anode supporting portion, the level of a signal from the sensor 28 can be regarded as corresponding to the temperature of the bearing section 22. Thus, the signal from the temperature sensor 28 is supplied to a temperature sensing comparator 29. Further, an output control signal from the comparator 29 is supplied to the power source 12 through a controller 30. The comparator 29 compares the level of the temperature signal from the temperature sensor 28 with a reference level which corresponds to a melting point of a lubricant. If the temperature signal level is lower than the reference eve, the controller 30 supplies the preheat control signal to the power source 12 to set the power source 12 in a preheating stage. In the preheating stage, the magnetic stator coil 11*b* is supplied with an AC voltage from the power source 12, which is adjusted to a frequency higher than the commercial power frequency (50 Hz or 60 Hz) and is low enough not to start the rotation of the rotator. The power source 12 incorporates an inverter power circuit for generating a voltage of a frequency higher than the commercial power frequency. If the temperature signal level is higher than the reference level, the controller 30 outputs a rotation start signal to set the power source in a prerotation stage. Thereafter, the power source is set in a steady rotation stage. In the prerotation stage, prerotation drive voltage is applied to the magnetic stator coil 11*b* in response to the rotation start signal so that the rotating structure 16 is started to rotate and is rotated at a relatively high frequency. Thereafter, the power source 12 is switched from the prerotation stage to the steady rotation stage by the controller 30 so that a rotation drive voltage for a steady-state rotation is supplied from the power source 12 to the magnetic stator coil 11*b* and the rotating structure 16 is rotated in a steady state. In order to enable these operations and signal processing, each section is provided with a microcomputer, which is loaded with sequence control programs.

Figures 2A, 2B:
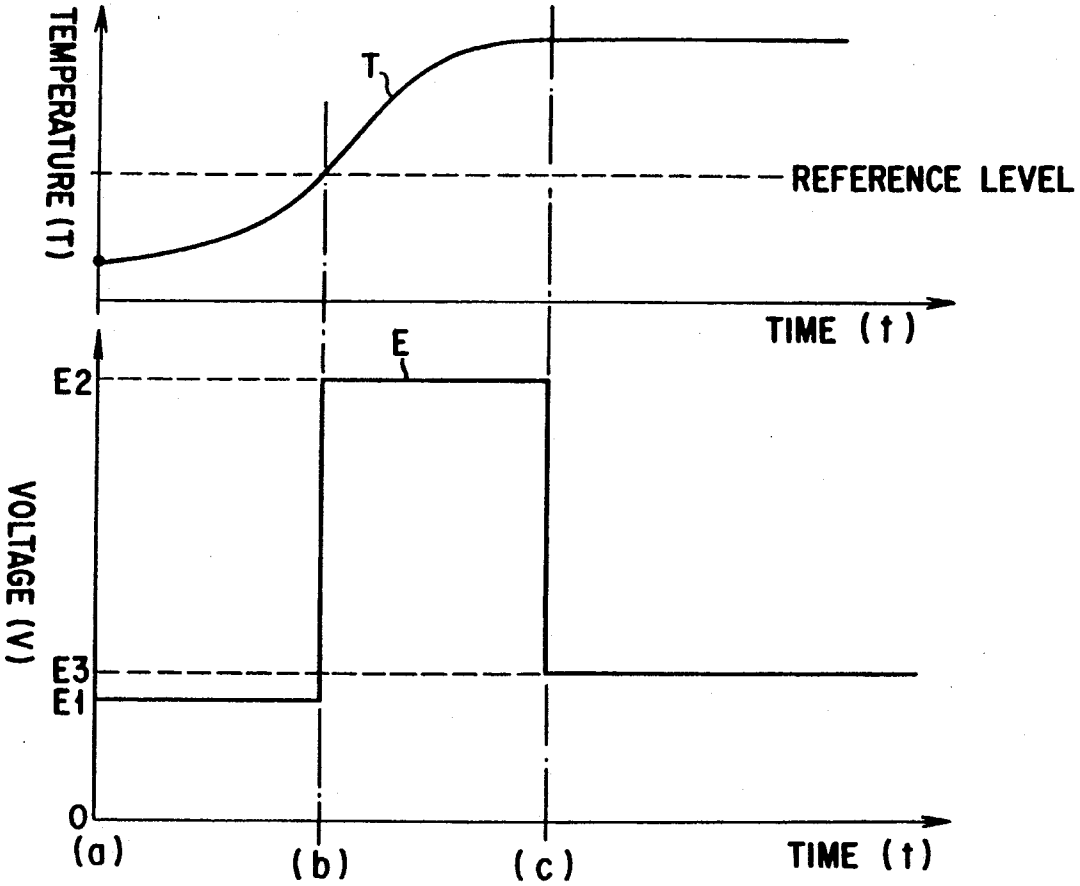
FIGS. 2A and 2B are sequence control diagrams illustrating the operation of the apparatus shown in FIG. 1.

Referring now to FIGS. 2A and 2B, an example of the operation of the apparatus shown in FIG. 1 will be described. The metal lubricant filled in the slide bearing section of the X-ray tube is supposed to be a material having a melting point of about 10° C. The reference level preset in the temperature comparator 29 is adjusted to a level corresponding to a temperature, e.g., 15° C., which is sufficiently higher than the melting point of the lubricant. If it is supposed that the X-ray apparatus is kept at an ambient temperature of about 5° C., then the temperature (T) of the bearing section is also about 5° C. Naturally, the lubricant kept substantially at this temperature, is in a frozen state. This temperature is detected by the sensor 28, and a temperature signal generated from the sensor 28 is applied to the comparator 29. This state is represented by point (a) on the time base (t) of FIG. 2B. The temperature comparator 29 concludes by calculation and comparison that the temperature of the bearing section is lower than the reference level, and the controller 30 supplies the preheat control signal to the power source 12 to set the power source in the preheating stage. Thus, the magnetic stator coil 11*b* is supplied with an preheat voltage (E1) (e.g., 40 V), as shown in a voltage curve E, which is adjusted to a frequency (e.g., 210 Hz) higher than the commercial power frequency and is low enough not to start the rotation of the rotating structure, as mentioned before. In response to this, a high-frequency rotating magnetic field (at 210 Hz in the above-described example) is generated from the magnetic stator coil 11*b*, so that an induced eddy current loss is caused in the rotating structure and the stationary column of the X-ray tube, and the temperature of the bearing section gradually increases as shown in a temperature curve T. According to this embodiment, in particular, the spiral groove bearings are coaxially arranged inside the stator coil 11*b*, so that an AC magnetic field generated by the coil 11*b* can efficiently applied to the bearing components, and heat can be efficiently produced by the induced current loss. After the passage of about three minutes, for example, the temperature of the bearing section exceeds the reference level of 15° C. In this state, the metal lubricant in the bearing section is completely melted and liquid. This temperature relationship is discriminated by the temperature comparator 29, and a prerotation control signal is supplied from the controller 30 to the power source 12 so that the power supply to the magnetic stator coil 11*b* is switched to a prerotation voltage (E2) (e.g., 160 V) to start the rotation of the rotating structure 16. The time for this switching is represented by point (b) in FIG. 2B. When a predetermined rotational frequency is reached, thereafter, the power source 12 is switched from the prerotation stage to the steady rotation stage. That is, the power supply is switched to a steady rotation voltage (E3) of e.g. 50 V at a frequency of e.g. 70 Hz for steady-state rotation at time point (c). If the temperature of the bearing section at initial time point (a) is higher than the reference level, the controller 30 sets the power source in the prerotating stage so that the prerotation voltage (E2) is applied to the stator coil 11 and the prerotation is immediately started at time point (a). Thereafter, the power source 12 is switched from the prerotation stage to the steady rotation stage so that the steady rotation voltage (E3) of e.g. 50 V at a frequency of e.g. 70 Hz is applied to the stator coil 11*b*. The X-ray apparatus of the present invention is arranged so as to be automatically controlled in these sequences.

The voltage supplied to the magnetic stator coil 11*b* during the period between time points (a) and (b), in order to melt the lubricant, may be a voltage adjusted to a frequency as high as about 1 kHz, for example.

In the above described embodiment, the voltage applied to the stator coil 11*a* is switched from the level E1 to the level E2 and also switched from the level E2 to the level E2. In the modification of the embodiment, an electric current having a first level for inducing an heat in the bearing section may be supplied to the stator coil 11*a* for a heating period between the times (a) and (b) and another electric currents having second and third levels for rotating the rotating structure 16 may be selectively supplied to the stator coils 11*a* for a rotation periods between the times (b) and (c) and after the time (c), in stead of the changing the voltage level. In the circuit shown in FIG. 1, an impedance of the stator coil 11*a* is changed in accordance with the state of the metal lubricant. That is, an impedance of the stator coil 11*a* is changed when the rotating structure 16 starts to rotate. Thus, if a constant voltage is applied to the stator coil, the current level of the current supplied to the stator coil is changed. Accordingly, in the embodiments of the invention, electrical power may be changed for heating the bearing section and rotating the rotating structure, in stead of changing the voltage or current.

According to the foregoing embodiment, the temperature sensor is fixed to the anode supporting portion, which is connected thermally to the bearing section, so that the temperature of the bearing section can be detected indirectly. Alternatively, however, a small hole may be bored in the stationary column so as to extend close to the bearing section from outside the tube and a temperature sensor, such as a thermocouple, may be located in the small hole at the vicinity of the bearing section. According to this arrangement, the temperature of the bearing section can be detected substantially directly, so that higher accuracy control can be effected. Alternatively, moreover, the temperature of insulating oil in a housing for receiving an X-ray tube may be detected so that the temperature of the lubricant can be indirectly detected before the start of the rotation of the anode target of the X-ray tube. In this case, sequence control can be effected such that the lubricant is preheated in accordance with an oil temperature in stead of the temperature of the bearing section. Alternatively, furthermore, the room temperature at which the X-ray apparatus is kept may be detected so that the temperature of the bearing section can be indirectly detected. By setting the reference level at a suitable temperature, in this case, the rotating structure can be smoothly rotated.

Figure 3:
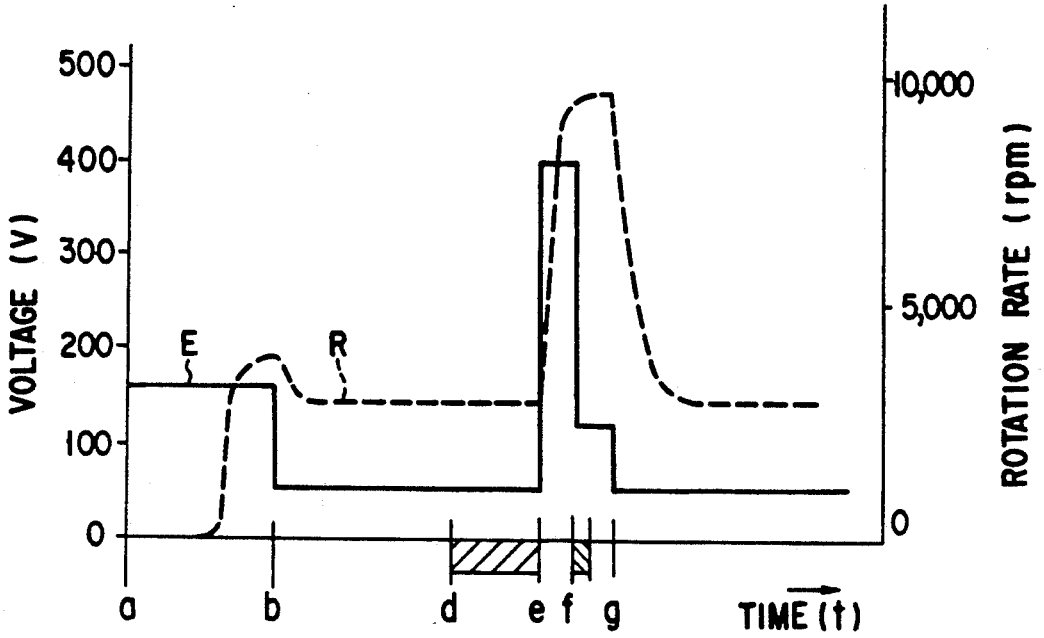
FIG. 3 is a sequence control diagram for an X-ray apparatus according to another embodiment of the invention.

Referring now to the sequence control diagram of FIG. 3, an X-ray apparatus according to another embodiment of the present invention will be described. Before the main power source of the X-ray apparatus is turned on, if the temperature of a spiral-groove bearing section of a rotating-anode X-ray tube is lower than the melting point of the lubricant, the lubricant is frozen. An AC voltage of 160 V at 70 Hz from the power source is first applied to a magnetic stator coil 11*a* at time point (a) and this voltage supply is continued for two minutes until time point (b), as shown in a curve E. In the meantime, the temperature of the bearing section is increased by magnetic induction heating, so that the lubricant is melted, whereupon an anode target starts to rotate. At time point (b), the rotation voltage supplied to the magnetic stator coil 11*a* is lowered to 50 V. At this time, the frequency is kept at 70 Hz. The rotational frequency R of the target is stabilized at about 3,000 rpm after increasing once, as indicated by broken line R in FIG. 3. In this state, a cathode-anode voltage is applied to the X-ray tube at time point (d), a fluoroscopic examination is made, and the region to be photographed, photographing timing, etc. are determined. When the fluoroscopy is finished at time point (e), the voltage supplied from the power source to the magnetic stator coil 11*a* is switched to 400 V at 210 Hz and, thereafter, to 130 V at 210 Hz. By doing this, the rotational frequency of the anode target increases to about 10,000 rpm. At this time point (f), a high voltage is applied between the anode 15 and the cathode 9 of the X-ray tube to effect X-ray photographing. The moment this photographing is finished, the voltage supplied to the magnetic stator coil 11*a* is lowered to 50 V at 70 Hz at time point (g). Thus, the rotational frequency of the anode target is stabilized at about 3,000 rpm, whereupon another fluoroscopic examination is started. These control processes are repeated.

Figure 4:
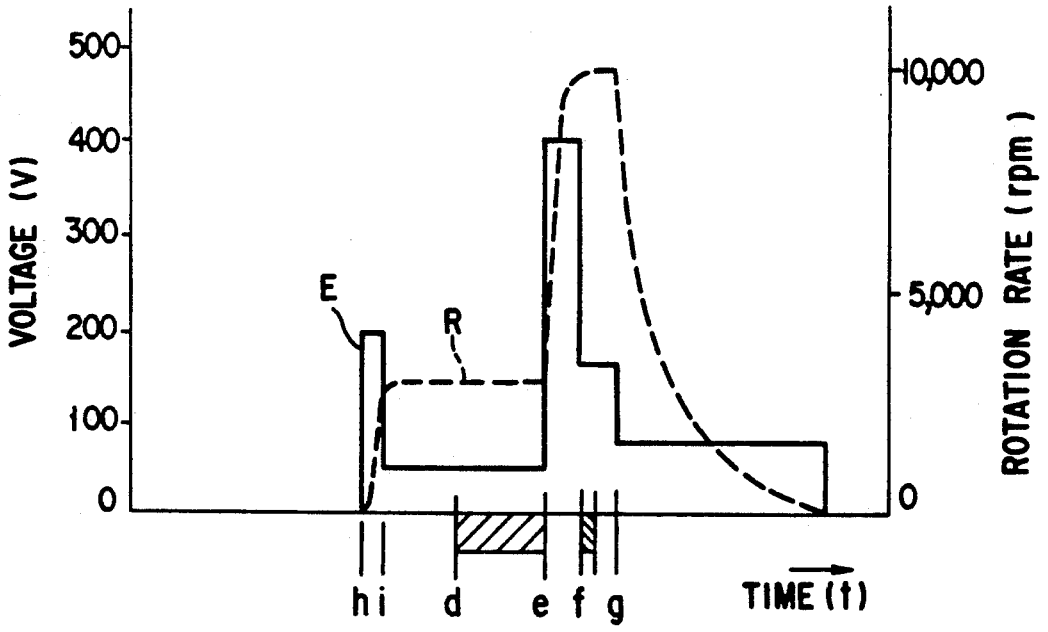
FIG. 4 is a sequence control diagram for a prior art X-ray apparatus with a conventional X-ray tube.

In a conventional X-ray apparatus which uses an X-ray tube having ball bearings lubricated by means of a solid metal lubricant, a rotation drive voltage of 200 V at 60 Hz is supplied to a magnetic stator coil for a short time of 1 seconds or less before fluoroscopic examination (at time point (h)), thereby starting rotation, as shown in FIG. 4. At time point (i) immediately after this, the supplied voltage is lowered to 50 V at 60 Hz, and photographing is then executed in the same manner as aforesaid. After the photographing is finished, the power supply to the magnetic stator coil is switched to a D.C. voltage in order to produce a braking effect, thereby stopping the rotation of an anode target soon, in order to minimize abrasion of the bearings and scattering or dissipation of the lubricant. Thus, starting control must be effected again during the period between time points (h) and (i) before starting the next cycle of fluoroscopy. As these processes of operation are repeated, an unreasonable stress repeatedly acts on the rotating mechanism in the X-ray tube, so that the bearing section is liable to suffer abrasion, vibration, and noises.

According to the present invention, once the lubricant is melted, the anode target can be always rotated at about 3,000 rpm with low vibration and low level of noises, and fluoroscopy can be effected as required in relatively short cycles. Since an undesired stress cannot easily act on the rotating mechanism in the X-ray tube, moreover, the tube can be used with reliability for a long period of time.

The respective currents of the primary and secondary windings of the magnetic stator coil 11*a* or the phase difference between these currents varies depending on the state, rotating or nonrotating, of the rotator. Accordingly, the apparatus may be arranged so that these currents of the stator coil are detected or monitored in the controller 30 for the comparison between a steady rotating state and a nonrotating state, so that the lubricant in the bearing section can be checked for freezing. In this case, a predetermined AC voltage is applied to the magnetic stator coil 11*a*, and the current of each winding or its phase is detected in the controller 30. An initially applied voltage is supposed to be high enough to start the rotation at once when the lubricant is melted. If the coil currents or phase difference corresponds to the melted state of the lubricant, which entails the immediate start of the rotation, the power supply to the magnetic stator 11*a* is switched to the voltage for steady-state rotation.

According to this arrangement of the apparatus, the state, melted or not, of the lubricant in the bearing section can be detected substantially directly, so that the rotation can be suitably controlled depending on the lubricant state. Thus, the apparatus can enjoy high-reliability operation despite the relatively simple construction, requiring no use of temperature sensor means for the bearing section or the like.

Alternatively the apparatus may be designed so that the sequence control never fails to include a process in which a voltage low enough not to start the rotation of the rotator, even though the lubricant is liquid at an optional frequency, is applied to the magnetic stator coil for a predetermined time (any set time from 10 seconds to 10 minutes). According to this arrangement, the rotation of the anode target can be started after the rotator or stationary column, which constitutes the spiral-groove bearing section, is securely heated by magnetic induction to melt the metal lubricant in the bearing section, without regard to the working temperature of the apparatus. Consequently, the apparatus can maintain safe and stable operation with its relatively simple construction without the use of any temperature sensor.

According to the present invention, as described above, the lubricant in the bearing section can be efficiently heated to be melted, thereby allowing the rotation to be started, without the additional use of any extra heating means in- or outside the X-ray tube. Thus, the X-ray apparatus can enjoy stable operation even at a temperature lower than the melting point of the lubricant.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An X-ray apparatus comprising:

an anode target;

a rotating structure fixedly fitted with the anode target;

a stationary structure for rotatably supporting the rotating structure;

a slide bearing section formed between the rotating structure and the stationary structure and including a bearing gap between the stationary structure and the rotating structure and spiral grooves formed on at least one of the rotating and stationary structures;

a metal lubricant having a melting point and applied in the spiral bearing section, the metal lubricant being in a liquid state at a temperature higher than the melting point and the metal lubricant being in a solid state at a temperature lower than the melting point;

an envelope for receiving the anode target and the stationary and rotating structures;

a magnetic stator coil, arranged outside of the envelope, for generating a magnetic field to rotate the rotating structure;

a power source for selectively applying preheating and rotation electric powers to the magnetic stator coil, thereby energizing the coil; and means for setting the power source in a preheating stage when the metal lubricant is in the solid state and in a rotation state when the metal lubricant is in the liquid stage, wherein the setting means causes the power source to apply the preheating electric power to the stator coil in the preheating stage so that the bearing section is heated by magnetic induction caused by the magnetic field, whereby the lubricant in the bearing section is melted, and the setting means causes the power source to apply the rotation electric power to the stator coil in the rotation stage so that the rotating structure is rotated by the magnetic field.

2. An X-ray apparatus according to claim 1, wherein the setting means includes means for sensing a temperature of the bearing section to generate a detection signal corresponding to the temperature of the bearing section, the setting means set the power source in one of the preheating and rotation stages in accordance to the detection signal.

3. An X-ray apparatus according to claim 2, wherein the setting means includes means for comparing the detection signal with a reference level corresponding to the melting point of the liquid metal lubricant to generate a comparison signal, and means for controlling the power source in accordance with the comparison signal, the controlling means causing the stator coil to start rotation only when the detection signal is higher than the reference level.

4. An X-ray apparatus according to claim 1, wherein the setting means includes means for detecting an electric current flowing through the magnetic stator coil, the setting means set the power source in one of the preheating and rotation stages in accordance to the detection signal.

5. An X-ray apparatus according to claim 1, wherein setting means causes the power source to apply the preheating electric power for a predetermined period in the preheating stage.

6. An X-ray apparatus according to claim 1, wherein the power source generates the preheating electric power which has a insufficient level and frequency for rotating the rotating structure in the preheating stage.

7. An X-ray apparatus according to claim 1, wherein the preheating electric power has a frequency higher than the commercial power frequency.

8. An X-ray apparatus according to claim 1, wherein the rotation stage includes a prerotation stage in which said setting means causes the power source to generate a prerotation electric power having a first level, and a steady rotation stage in which the setting means causes the power source to generate a steady rotation electric power having a second level lower than the first level.

9. An X-ray apparatus according to claim 1, wherein the preheating electric power have a first level and the rotation electric power have a second level which is lower than the first level and the preheating electric power is applied to the stator coil for a predetermined period which is sufficient for melting the metal lubricant.

10. An X-ray apparatus comprising:

an X-ray tube including:

an anode target;

a rotating structure fixedly fitted with an anode target;

a stationary structure for rotatably supporting the rotating structure;

a slide bearing section formed between the rotating structure and the stationary structure and including a bearing gap between the stationary structure and the rotating structure and spiral grooves formed on one of the rotating structure and the stationary structure;

a metal lubricant having a melting point and applied in the bearing section; and an envelope for receiving the anode target and the stationary and rotating structures;

a magnetic stator coil surrounding the rotating structure, for generating a magnetic field for rotating the rotating structure;

a power source for selectively applying preheating and rotation voltages to the magnetic stator coil, thereby energizing the stator coil, and means for setting the power source in one of preheating and rotation stages, wherein the setting means causes the power source, in the preheating stage, to generate the preheating voltage having a level enough not to rotate the rotating structure and sufficient for generating a magnetic field to induce a heat applied to the bearing section and melt the metal lubricant for a predetermined period and the setting means causes the power source to generate the rotation voltage having a level enough to rotate the rotating structure in the rotation stage.

11. An X-ray apparatus according to claim 8, wherein the rotation stage includes a prerotation stage in which said setting means causes the power source to generate a prerotation voltage having a first level, and a steady rotation stage in which the setting means causes the power source to generate a steady rotation voltage having a second level lower than the first level.

12. An X-ray apparatus comprising:

an anode target;

a rotating structure fixedly fitted with the anode target;

a stationary structure for rotatably supporting the rotating structure;

a slide bearing section formed between the rotating structure and the stationary structure and including a bearing gap between the stationary structure and the rotating structure and spiral grooves formed on one of the rotating and stationary structures;

a metal lubricant having a melting point and applied in the spiral bearing section, the metal lubricant being in a liquid state at a temperature higher than the melting point and the metal lubricant being in a solid state at a temperature lower than the melting point;

an envelope for receiving the anode target and the stationary and rotating structures;

a magnetic stator coil, arranged outside of the envelope, for generating a magnetic field to rotate the rotating structure;

a power source for selectively applying first and second voltages to the magnetic stator coil, thereby energizing the coil; and means for controlling the power source to generate the first voltage having a first level when the metal lubricant is in the solid state and to generate the second voltage having a second level when the metal lubricant is in the liquid stage, wherein the stator coil applied with the first voltage generates the magnetic field inducing a heat which is sufficient to melt the metal lubricant and the stator coil applied with the second voltage generates the magnetic field for rotating the rotating structure.

13. An X-ray apparatus according to claim 12, wherein the controlling means includes means for monitoring the rotation of the rotating structure to generate a monitoring signal, the controlling means so controlling the power source as to switch the first voltage to the second voltage in accordance with the monitoring signal.

14. An X-ray apparatus comprising:

an anode target;

a rotating structure fixedly fitted with the anode target;

a stationary structure for supporting the rotating structure;

a slide bearing section formed between the rotating structure and the stationary structure and including a bearing gap between the stationary structure and the rotating structure and spiral grooves formed on one of the rotating and stationary structures;

a metal lubricant and applied in the spiral bearing section;

an envelope for receiving the anode target and the stationary and rotating structures;

a magnetic stator coil, arranged outside of the envelope, for generating a magnetic field to rotate the rotating structure;

a power source for selectively applying first and second electric powers to the magnetic stator coil, thereby energizing the coil; and means for setting the power source to generate the first electric power for a predetermined heating period and to generate the second electric power after the heating period, wherein the stator coil applied with the first electric power generates the magnetic field inducing a heat which is applied to the bearing section and the stator coil applied with the second electric power generates the magnetic field for rotating the rotating structure.

* * * * *